US009270026B2

(12) United States Patent
Kyriazidou

(10) Patent No.: US 9,270,026 B2
(45) Date of Patent: Feb. 23, 2016

(54) RECONFIGURABLE POLARIZATION ANTENNA

(75) Inventor: Chryssoula A. Kyriazidou, Kifisia (GR)

(73) Assignee: Broadcom Corporation, Irvine, CA (US)

( * ) Notice: Subject to any disclaimer, the term of this patent is extended or adjusted under 35 U.S.C. 154(b) by 0 days.

(21) Appl. No.: 13/361,570

(22) Filed: Jan. 30, 2012

(65) Prior Publication Data

US 2013/0113673 A1 May 9, 2013

Related U.S. Application Data

(60) Provisional application No. 61/556,094, filed on Nov. 4, 2011.

(30) Foreign Application Priority Data

Dec. 28, 2011 (GR) ..... 20110100742

(51) Int. Cl.
*H01Q 1/38* (2006.01)
*H01Q 9/04* (2006.01)

(52) U.S. Cl.
CPC ..... *H01Q 9/0428* (2013.01); *H01Q 9/045* (2013.01); *H01Q 9/0421* (2013.01)

(58) Field of Classification Search
CPC ..... H01Q 1/48; H01Q 9/40; H01Q 9/0428
USPC ..... 343/700 MS, 846, 848, 853
See application file for complete search history.

(56) References Cited

U.S. PATENT DOCUMENTS

| | | | | |
|---|---|---|---|---|
| 6,662,028 | B1 * | 12/2003 | Hayes et al. | 455/575.7 |
| 6,771,223 | B1 * | 8/2004 | Shoji et al. | 343/702 |
| 7,084,815 | B2 | 8/2006 | Phillips et al. | |
| 2007/0030208 | A1 * | 2/2007 | Linehan | 343/757 |

(Continued)

FOREIGN PATENT DOCUMENTS

| | | | |
|---|---|---|---|
| CN | 201966318 | U | 9/2011 |
| EP | 1 335 449 | A1 | 8/2003 |

(Continued)

OTHER PUBLICATIONS

JP 2005039756 A (Noro et al.)—English.*

(Continued)

*Primary Examiner* — Dameon E Levi
*Assistant Examiner* — Collin Dawkins
(74) *Attorney, Agent, or Firm* — Sterne, Kessler, Goldstein & Fox P.L.L.C.

(57) ABSTRACT

Embodiments include antenna systems capable of producing high quality circularly, elliptically, or linearly polarized radiation. Embodiments include single feed (single-ended or differential) or multiple feed antennas. Embodiments can be electronically configured to adjust the type of polarization of the antenna system. In an embodiment, the polarization of the antenna system is adjusted by adjusting at least the position of a grounding node relative to the position of a feed node. In another embodiment, the polarization of the antenna system is adjusted by configuring one or more input nodes of the antenna between feed nodes, grounding nodes, and open nodes. In another embodiment, the polarization of the antenna system is adjusted by adjusting the phase of a single differential feed of the system.

22 Claims, 8 Drawing Sheets

(56) References Cited

U.S. PATENT DOCUMENTS

| | | | | |
|---|---|---|---|---|
| 2008/0018542 | A1* | 1/2008 | Yamazaki et al. | 343/702 |
| 2008/0136727 | A1* | 6/2008 | Bit-Babik et al. | 343/848 |
| 2008/0284661 | A1* | 11/2008 | He | 343/700 MS |
| 2009/0009417 | A1* | 1/2009 | Matsushita et al. | 343/770 |
| 2009/0140927 | A1* | 6/2009 | Maeda et al. | 343/700 MS |
| 2009/0322631 | A1* | 12/2009 | Huchard et al. | 343/720 |
| 2010/0109846 | A1* | 5/2010 | Nagai | 340/10.1 |
| 2010/0117923 | A1* | 5/2010 | Storz | 343/878 |
| 2010/0214191 | A1* | 8/2010 | Teng et al. | 343/843 |

FOREIGN PATENT DOCUMENTS

| | | | | |
|---|---|---|---|---|
| EP | 1693925 | A1 * | 8/2006 | H01Q 1/24 |
| JP | 2005-039756 | A | 2/2005 | |
| JP | 2005039756 | A * | 2/2005 | H01Q 13/08 |
| TW | 200536183 | | 11/2005 | |
| WO | WO 2008/147467 | A2 | 12/2008 | |

OTHER PUBLICATIONS

European Search Report for EP Application No. EP 12 00 6127, Munich, Germany, mailed on Feb. 5, 2013.

Office Action directed to related Chinese Patent Application No. 201210365964.7, mailed Jun. 27, 2014; 7 pages.

English-language abstract of Chinese Patent Publication No. 201966318 U; 2 pages.

Office Action directed to related Taiwanese Patent Application No. 101133669, mailed Mar. 9, 2015.

* cited by examiner

300

500

700

700

RECONFIGURABLE POLARIZATION ANTENNA

CROSS-REFERENCE TO RELATED APPLICATION(S)

This patent application claims the benefit of U.S. Provisional Patent Application No. 61/556,094, filed Nov. 4, 2011, entitled "Long Term Evolution Radio Frequency Integrated Circuit," which is incorporated herein by reference in its entirety.

BACKGROUND

1. Field of the Invention

The field of the invention relates generally to antennas.

2. Background Art

To produce a circularly polarized antenna, conventional approaches produce two orthogonal linearly polarized electric field components by providing two feeds to the antenna. The two feeds excite two orthogonal (e.g., X direction, Y direction) electromagnetic field modes such that one of the modes is excited with a 90 degrees phase delay relative to the other mode. Circular polarization (CP) may also be achieved using a single feed by placing the feed along one of the diagonals in a square patch, by including thin diagonal slots in a square patch, by elliptical patch shapes, or by trimming opposite corners in a square patch.

In certain conditions, conventional methods for producing CP may be inadequate. In addition, there is a need that the antenna system be re-configurable to produce as many types of polarizations as possible, to increase its utility.

BRIEF DESCRIPTION OF THE DRAWINGS/FIGURES

The accompanying drawings, which are incorporated herein and form a part of the specification, illustrate the present disclosure and, together with the description, further serve to explain the principles of the disclosure and to enable a person skilled in the pertinent art to make and use the subject matter of the disclosure.

The present disclosure will be described with reference to the accompanying drawings. Generally, the drawing in which an element first appears is typically indicated by the leftmost digit(s) in the corresponding reference number.

DETAILED DESCRIPTION OF EMBODIMENTS

Systems and methods of producing circular polarization over a wide frequency band are presented. The systems and methods involve the introduction of a grounding pin in the antenna element. The grounding pin enables an impedance and CP bandwidth of 25% or more.

Figure 1:
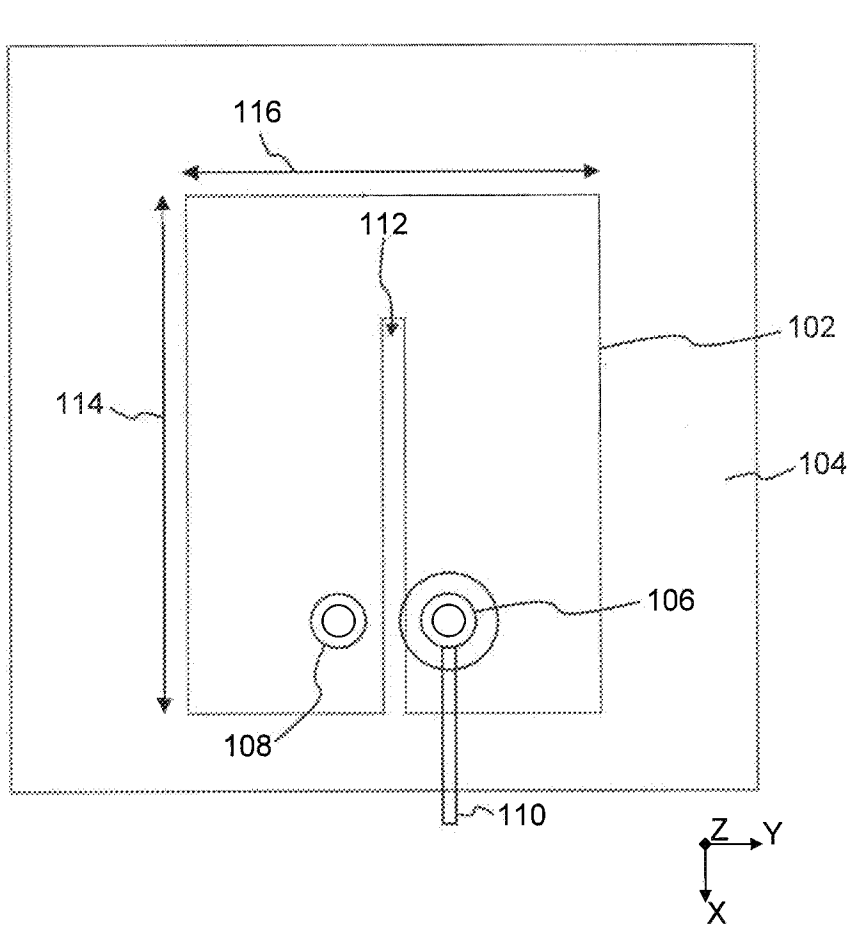
FIG. 1 is a top view of an example antenna system.

FIG. 1 is a top view of an example antenna system 100. Example antenna system 100 is provided for the purpose of illustration only and is not limiting of embodiments of the present disclosure. Example antenna system 100 includes an antenna element 102, a ground plane 104, and a feed line probe 110. As would be understood by a person of skill in the art based on the teachings herein, in other embodiments, antenna system 100 may include multiple antenna elements 102 or an array of antenna elements 102.

Antenna element 102 may be a printed or a microstrip antenna, such as a patch antenna, for example. As shown in FIG. 1, antenna element 102 has a rectangular shape, with an X-dimension 114 and a Y-dimension 116. A slot 112, formed within antenna element 102, additionally gives antenna element 102 a U-shape. In other embodiments, antenna element 102 may be square shaped, elliptical, circular, or of any other continuous shape.

Antenna element 102 is mounted above ground plane 104. In an embodiment, antenna element 102 is mounted above ground plane 104 using one or more dielectric spacer layers in between (not shown in FIG. 1). Antenna element 102 may be formed by etching an antenna pattern onto a dielectric or semiconductor substrate, for example. A feed line (to a transmitter or a receiver) is provided to antenna element 102 via a feed node 106, which is electrically coupled to feed line probe 110. A ground line is provided to antenna element 102 via a grounding node 108, which is electrically coupled to ground plane 104. In other embodiments, the ground line (and grounding node 108) are eliminated.

According to embodiments, antenna element 102 is configured to emit circularly polarized (CP) radiation. In a circular polarization, an emitted electromagnetic wave has an electric field that is constant in amplitude but that rotates in direction as the electromagnetic wave travels (the associated magnetic field is also constant and rotates in direction, perpendicular to the electric field). The electric field can rotate in a clockwise (right-handed circular polarization) or counter-clockwise (left-handed circular polarization) manner. An ideal CP electric field is made up of two orthogonal linearly polarized electric field components that have equal amplitude and are 90 degrees out-of-phase relative to each other.

To produce a CP antenna, conventional approaches produce two orthogonal linearly polarized electric field components by providing two feeds to the antenna. The two feeds excite two orthogonal (e.g., X direction, Y direction) electromagnetic field modes such that one of the modes is excited with a 90 degrees phase delay relative to the other mode. The ratio of amplitudes of the orthogonal electrical field components, known as the axial ratio (AR), is a measure of the quality of the produced circular polarization. A 0 dB AR is achieved when the antenna is operated right in the middle between the resonance frequencies of the two excited modes such that the two modes have equal amplitude.

In example antenna system 100, circular polarization is achieved with a single feed over a desired frequency range (desired CP bandwidth). At least one feed is thus eliminated compared to conventional designs. According to embodiments, circular polarization is achieved by selecting/configuring one or more of X-dimension 114, Y-dimension 116, the ratio of X-dimension 114 to Y-dimension 116, the size of antenna element 102 relative to ground plane 104, the position of feed node 106 within antenna element 102, the position of grounding node 108 within antenna element 102, and the position of grounding node 108 relative to feed node 106, such that two orthogonal electromagnetic field modes are excited over the desired CP bandwidth.

Further tuning of one or more of the above listed parameters allows the produced circular polarization to meet a desired quality (e.g., AR) over the desired CP bandwidth. In an embodiment, the desired CP quality is achieved by configuring/tuning only the positions of feed node 106 and grounding node 108 within antenna element 102. In another embodiment, the desired CI quality is achieved by configuring/tuning only the size/shape of antenna element 102 and the position of feed node 106.

In addition to potentially aiding in achieving circular polarization, X-dimension 114 and Y-dimension 116 of antenna element 102 affect the impedance bandwidth of antenna element 102. The impedance bandwidth of an antenna is the useable frequency range of the antenna, compared to a known impedance (e.g., 50 Ohms). Thus, in embodiments, X-dimension 114 and Y-dimension 116 of antenna element 102 are selected such that a desired impedance bandwidth of antenna element 102 is achieved. Slot 112 within antenna element 102 may also be used to achieve the desired impedance bandwidth by reducing signal reflection by antenna element 102.

Furthermore, in an embodiment, one or more of X-dimension 114, Y-dimension 116, the ratio of X-dimension 114 to Y-dimension 116, the size of antenna element 102 relative to ground plane 104, the position of feed node 106 within antenna element 102, the position of grounding node 108 within antenna element 102, and the position of grounding node 108 relative to feed node 106 are further selected/configured such that the impedance bandwidth of antenna element 102 coincides with the desired CP bandwidth of antenna element 102 over a wide band. This enables antenna element 102 to produce high quality circular polarization over a wide useable frequency range (i.e., in which antenna element 102 has low return loss).

Figure 2:
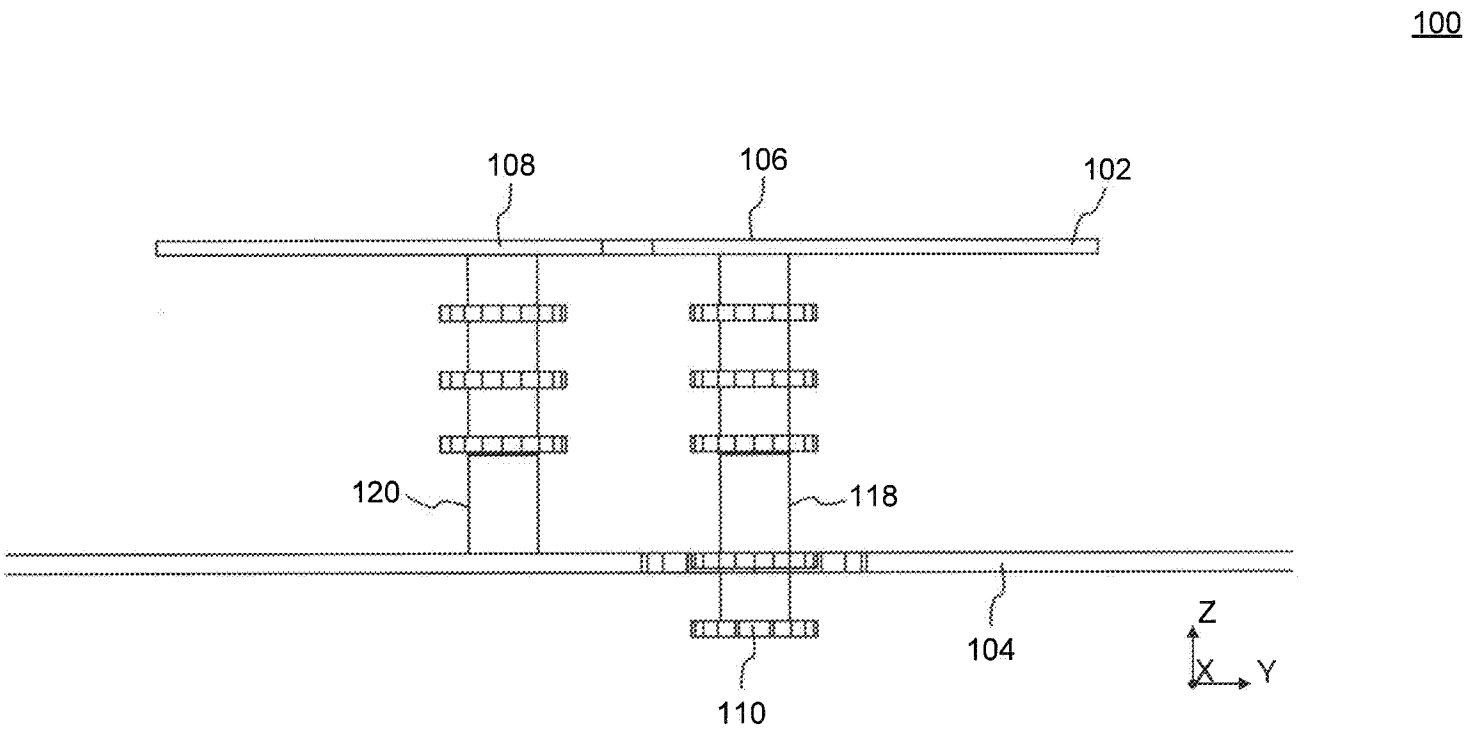
FIG. 2 is a side view of an example antenna system.

FIG. 2 is a side view of example antenna system 100 described above in FIG. 1. As shown in FIG. 2, in an embodiment, feed node 106 is electrically coupled to feed line probe 110 using a through-chip via 118. Similarly, grounding node 108 is electrically coupled to ground plane 104 using a through-chip via 120. Other ways for interconnecting feed node 106 and grounding node 108 to feed line probe 110 and ground plane 104, respectively, may also be used as would be understood by a person of skill in the art.

Figure 3:
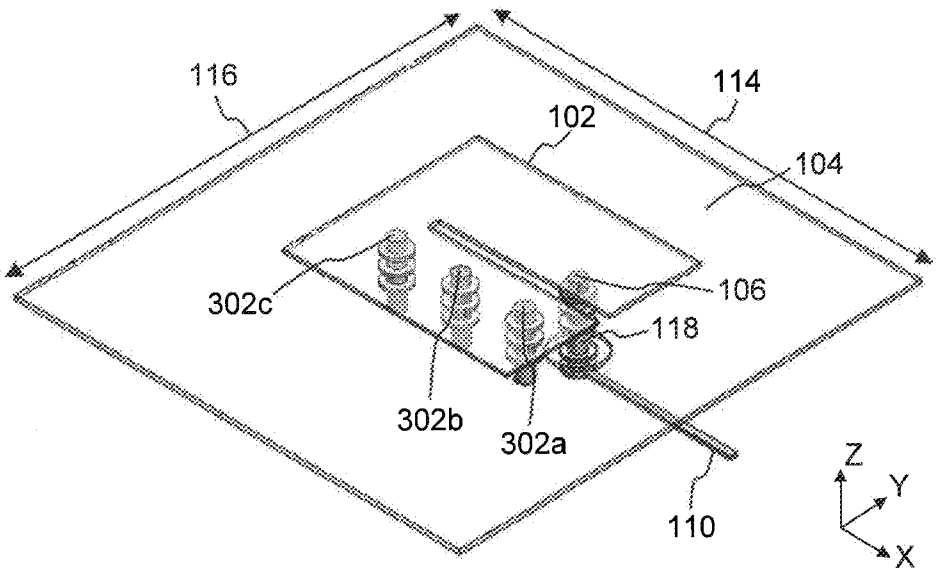
FIG. 3 is a three-dimensional view of an example antenna system.

FIG. 3 is a three-dimensional view of an example antenna system 300. Example antenna system 300 is provided for the purpose of illustration only and is not limiting of embodiments of the present disclosure. Like example antenna. system 100, example antenna system 300 includes an antenna element 102, a ground plane 104, and a feed line probe 110. As would be understood by a person of skill in the art based on the teachings herein, in other embodiments, antenna system 300 may include multiple antenna elements 102 or an array of antenna elements 102.

As shown in FIG. 3, antenna element 102 is mounted above ground plane 104. In an embodiment, antenna element 102 is mounted above ground plane 104 using one or more dielectric spacer layers in between (not shown in FIG. 3). A feed line (to a transmitter or a receiver) is provided to antenna element 102 via a feed node 106, which is electrically coupled using a through-chip via 118 to feed line probe 110.

Antenna element 102 also includes three grounding nodes 302*a-c* (any other number of grounding nodes may be used), each of which may be electrically coupled to ground plane 104. In embodiments, each of grounding nodes 302*a-c* can be coupled to ground plane 104, independently of the other grounding nodes. Accordingly, any number of grounding nodes 302*a-c* may be coupled to ground plane 104 at any time. For example, more than one of grounding nodes 302*a-c* may be coupled to ground plane 104 at the same time.

In an embodiment, the number and/or positions of grounding nodes 302*a-c* that are electrically coupled to ground plane 104 is determined by the type of desired polarization of antenna system 300. For example, in embodiments, for circular polarization, grounding node 302*a* is electrically coupled to ground plane 104 and grounding nodes 302*b* and 302*c* are left open. In this configuration, two orthogonal electromagnetic field modes are excited. For elliptical radiation, grounding node 302*b* is electrically coupled to ground plane 104 and grounding nodes 302*a* and 302*c* are left open. For linear polarization, grounding node 302*c* is electrically coupled to ground plane 104 and grounding nodes 302*a* and 302*b* are left open. This configuration excites a single electromagnetic field mode. Other types of polarizations may also be realized by coupling more than one of grounding nodes 302*a-c* at the same time.

As in example antenna system 100 described above, each of the different types of polarizations (i.e., circular, elliptical, linear) can be achieved in antenna system 300 with a single feed over a desired polarization bandwidth. At least one feed is thus eliminated compared to conventional designs, in the case of circular polarization.

In embodiments, in addition to selecting the number and/or positions of grounding nodes 302*a-c* to couple to ground plane 104, other parameters of antenna system 300 may need to be configured/tuned. These parameters include, for example, one or more of X-dimension 114, Y-dimension 116, the ratio of X-dimension 114 to Y-dimension 116, the size of antenna element 102 relative to ground plane 104, the position of feed node 106 within antenna element 102, the positions of grounding nodes 302*a-c* within antenna element 102, and the positions of grounding nodes 302*a-c* relative to feed node 106.

In an embodiment, each of grounding nodes 302*a-c* may be electrically coupled to ground plane 104 or left open by controlling a respective switch (not shown in FIG. 3), located between the grounding node 302 and ground plane 104. The respective switches may be controlled using respective control signals. As such, the polarization type of antenna system 300 can be adjusted dynamically, as desired, by controlling the respective switches. For example, in an application involving a wide frequency band composed of many sub-channels, antenna system 300 may be reconfigured to radiate a different polarization type per sub-channel.

Figure 4:
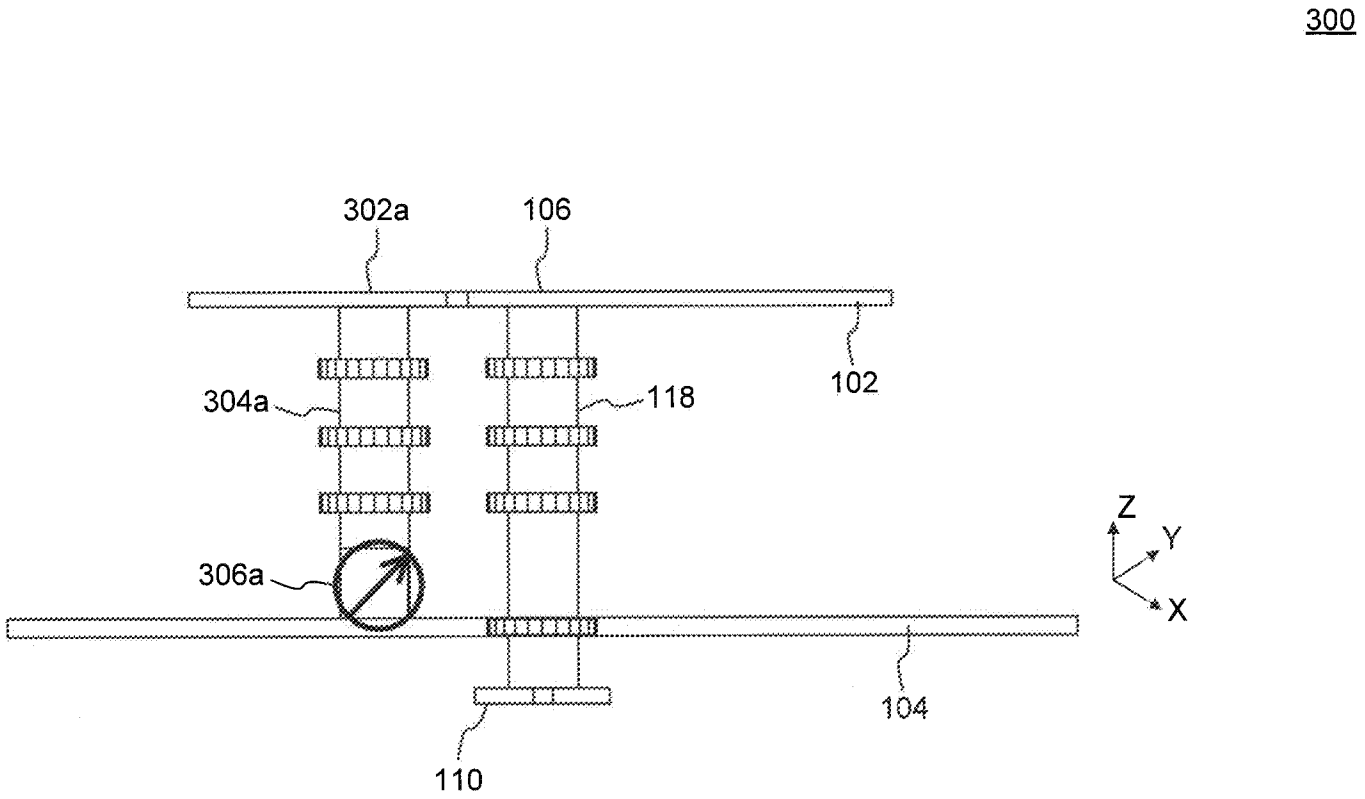
FIG. 4 is a side view of an example antenna system.

FIG. 4 is a side view of example antenna system 300 described above in FIG. 3. As shown in FIG. 4, in an embodiment, each of grounding nodes 302*a-c* is coupled to ground plane 104 via a respective through-chip via 304 and a respective switch 306. In FIG. 4, only through-chip via 304*a* and switch 306*a* that correspond to grounding node 302*a* are shown. When switch 306*a* is closed, grounding node 302*a* is electrically coupled to ground plane 104. Otherwise, grounding node 302*a* is open. In an embodiment, switch 306*a* includes a varactor (variable capacitance diode), controlled by a respective control signal to vary its capacitance. Other types of active switches may also be used for switch 306*a*. Other ways for interconnecting grounding nodes 302*a-c* to ground plane 104 may also be used as would be understood by a person of skill in the art.

Figure 5:
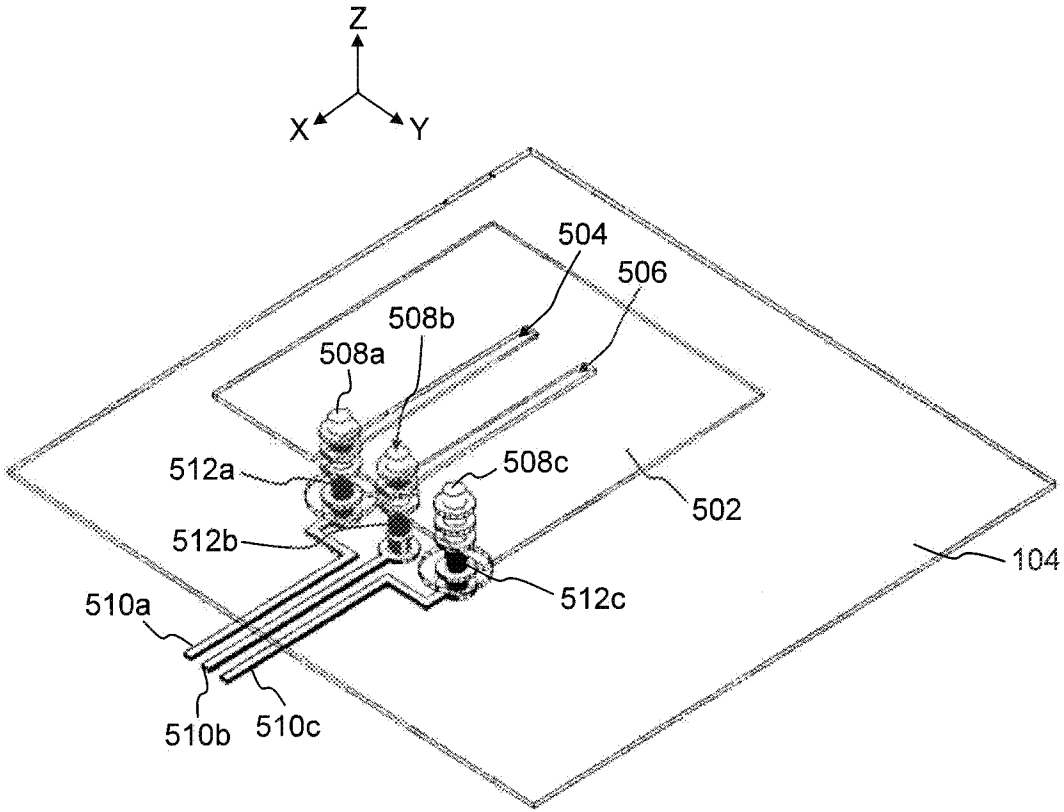
FIG. 5 is a three-dimensional view of an example antenna system.

FIG. 5 is a three-dimensional view of an example antenna system 500. Example antenna system 500 is provided for the purpose of illustration only and is not limiting of embodiments of the present disclosure. Example antenna system 500 includes an antenna element 502, a ground plane 104, and a plurality of input probes 510*a-c*. As would be understood by a person of skill in the art based on the teachings herein, in other embodiments, antenna system 500 may include multiple antenna elements 502 or an array of antenna elements 502.

Antenna element 502 may be a printed or a microstrip antenna, such as a patch antenna, for example. As shown in FIG. 5, antenna element 502 has a square shape. Two slots 504 and 506, formed within antenna element 502, additionally give antenna element 502 a W-shape. In other embodiments, antenna element 502 may be rectangular, elliptical, circular, or of any other continuous shape.

Antenna element 502 is mounted above ground plane 104. In an embodiment, antenna element 502 is mounted above ground plane 104 using one or more dielectric spacer layers in between (not shown in FIG. 5). Antenna element 102 may be formed by etching an antenna pattern onto a dielectric or semiconductor substrate, for example. Antenna element 502 includes a plurality of nodes 508*a-c*. Nodes 508*a-c* are electrically coupled, using respective through-chip vias 512*a-c*, to input probes 510*a-c*, respectively.

According to embodiments, input probes 510*a-c* can be used to variably feed antenna element 502, such that each of nodes 508*a-c* can be configured as a feed node, a grounding node, or an open node, independently of the other nodes. In an embodiment, a switching mechanism (including one or more switches, not shown in FIG. 5) is used to couple respective input signals to input probes 510*a-c*, thereby configuring nodes 508*a-c*. Depending on the configuration of nodes 508*a-c*, a respective polarization type can be realized using antenna system 500. For example, antenna element 502 may be fed to excite two orthogonal modes, to produce (right-handed or left-handed) circularly polarized radiation. Alternatively, antenna element 502 may be fed to excite a single mode, to produce linearly polarized radiation. Nodes 508*a-c* can be re-configured to adjust the polarization of antenna system 500, as desired.

As in example antenna system 100 described above, each of the different types of polarizations (i.e., circular, elliptical, linear) can be achieved in antenna system 500 with a single feed over a desired polarization bandwidth. At least one feed is thus eliminated compared to conventional designs, in the case of circular polarization. In other embodiments, the different polarizations are achieved using two or more feeds.

Figure 6:
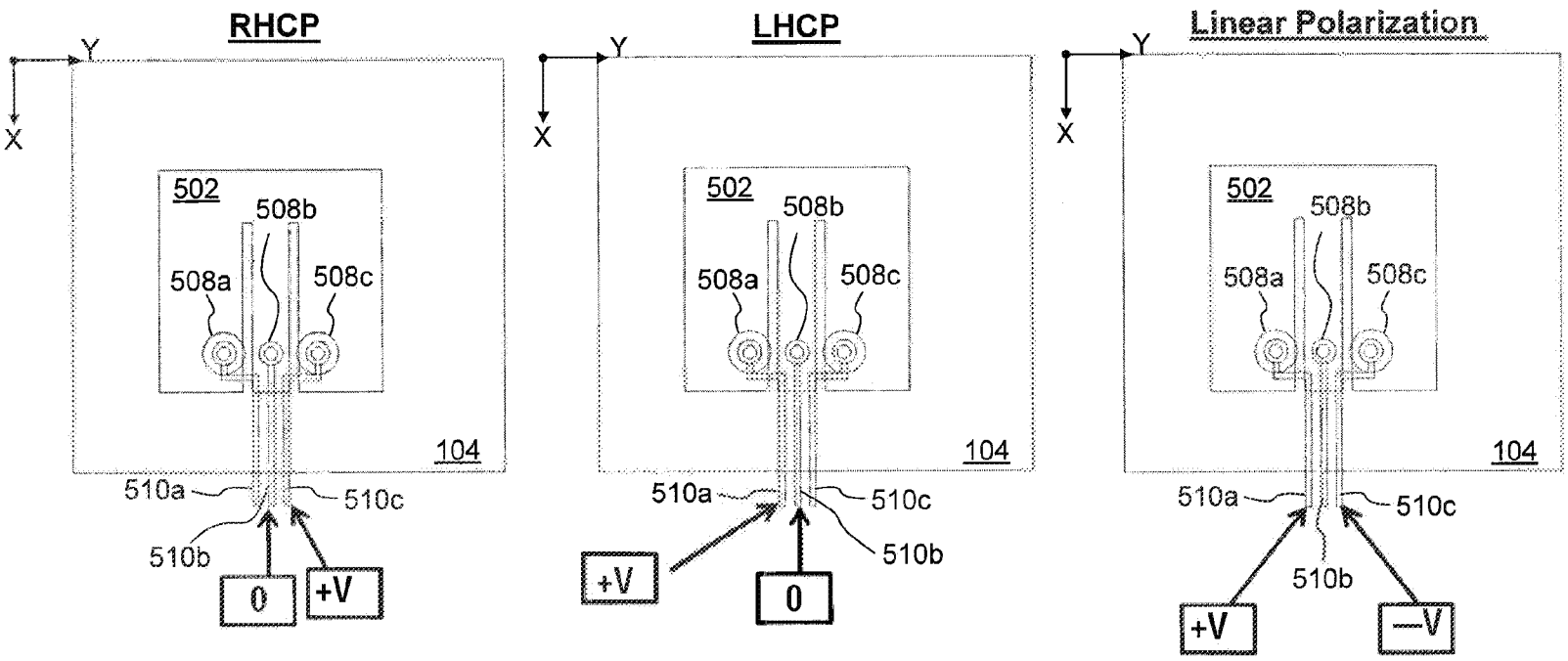
FIG. 6 illustrates example configurations of an example antenna system.

FIG. 6 illustrates example configurations of example antenna system 500. As would be understood by a person of skill in the art based on the teachings herein, the example configurations of FIG. 6 are provided for the purpose of illustration only and are not limiting of embodiments of the present disclosure.

As described above, different polarization types can be achieved using example antenna system 500 by configuring nodes 508*a-c*, accordingly. For example, as shown in FIG. 6, right-handed circular polarization (RHCP) can be produced by configuring node 508*b* as a grounding node, node 508*c* as a feed node, and node 508*a* as an open node. In an embodiment, this is done by coupling (using the switching mechanism) a 0 (Volts) input signal to input probe 510*b*, which is coupled to node 508*b*, and a +V (Volts) input signal to input probe 510*c*, which is coupled to node 508*c*. Input probe 510*a* is left open. Similarly, left-handed circular polarization (LHCP) can be produced by configuring, in the same manner, node 508*b* as a grounding node, node 508*a* as a feed node, and node 508*c* as an open node.

Linear polarization can be achieved, in an embodiment, by configuring nodes 508*a* and 508*c* as feed nodes and leaving node 508*b* as an open node. As such, a +V (Volts) and a −V (Volts) input signals are applied, respectively, to input probes 510*a* and 510*c*, and input probe 510*b* is left open.

In an embodiment, any of the different feeding modes of input probes 510*a-c* can be activated by an appropriate configuration of the switching mechanism. In an embodiment, input signals −V (Volts), 0 (Volts), and +V (Volts) are provided to the switching mechanism, which couples the input signals to respective ones of input probes 510*a-c*, according to the desired configuration of antenna system 500.

Figure 7:
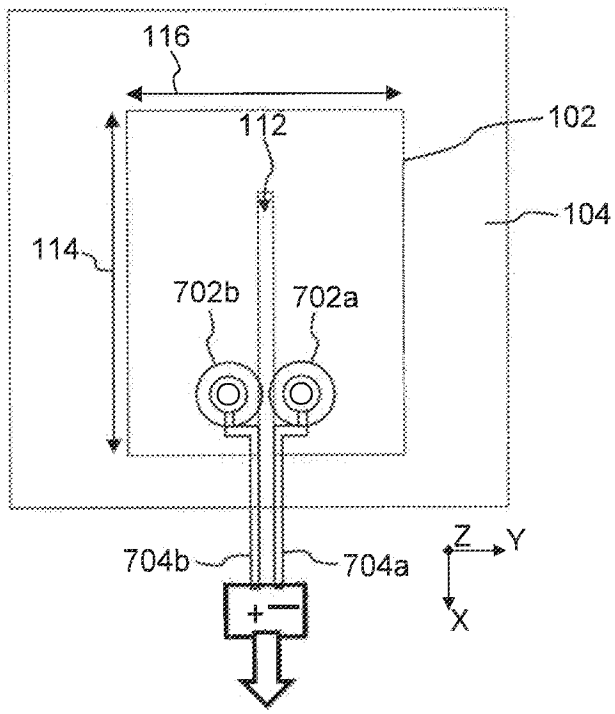
FIG. 7 is a top view of an example antenna system.

FIG. 7 is a top view of an example antenna system 700. Example antenna system 700 is provided for the purpose of illustration only and is not limiting of embodiments of the present disclosure. Example antenna system 700 includes an antenna element 102, a ground plane 104, and a plurality of feed line probes 704*a-b*. As would be understood by a person of skill in the art based on the teachings herein, in other embodiments, antenna system 700 may include multiple antenna elements 102 or an array of antenna elements 102.

Antenna element 102 is mounted above ground plane 104. In an embodiment, antenna element 102 is mounted above ground plane 104 using one or more dielectric spacer layers in between (not shown in FIG. 7). Antenna element 102 includes a plurality of feed nodes 702*a-b* (any other number of feed nodes may be used), each of which is electrically coupled to a respective one of feed line probes 704*a-b*. Antenna element 102 may also include one or more grounding nodes (not shown in FIG. 7).

According to embodiments, feed line probes 704*a-b* can be used to provide a single differential feed to antenna system 700. In an embodiment, the single differential feed is configured to excite two orthogonal modes such that antenna system 700 radiates circularly polarized waves over a desired CP bandwidth. In others embodiment, the single differential feed is adjusted in phase to produce other types of polarization.

In an embodiment, feed line probes 704*a-b* are coupled to outputs of a differential phase shifter (not shown in FIG. 7). The phase shifter can be used to adjust the phase (+/− 0-180 degrees) of its outputs, including performing a phase inversion by applying +/− 180 degrees phase shift to its outputs. Adjusting the phase of the outputs of the phase shifter varies the polarization type of antenna system 700. As such, the polarization of antenna system 700 can be configured/re-configured by configuring/re-configuring the phase shift of the outputs of the phase shifter, applied to feed line probes 704*a-b*. In an embodiment, the phase shifter is used to apply a phase inversion to its outputs, thereby causing the polarities of feed line probes 704*a-b* (and, by consequence, the polarities of feed nodes 702*a-b*) to be switched. As such, the circular polarization of antenna system 700 can be re-configured from a left-hand circular polarization to a right-handed circular polarization, or vice versa.

Figure 8:
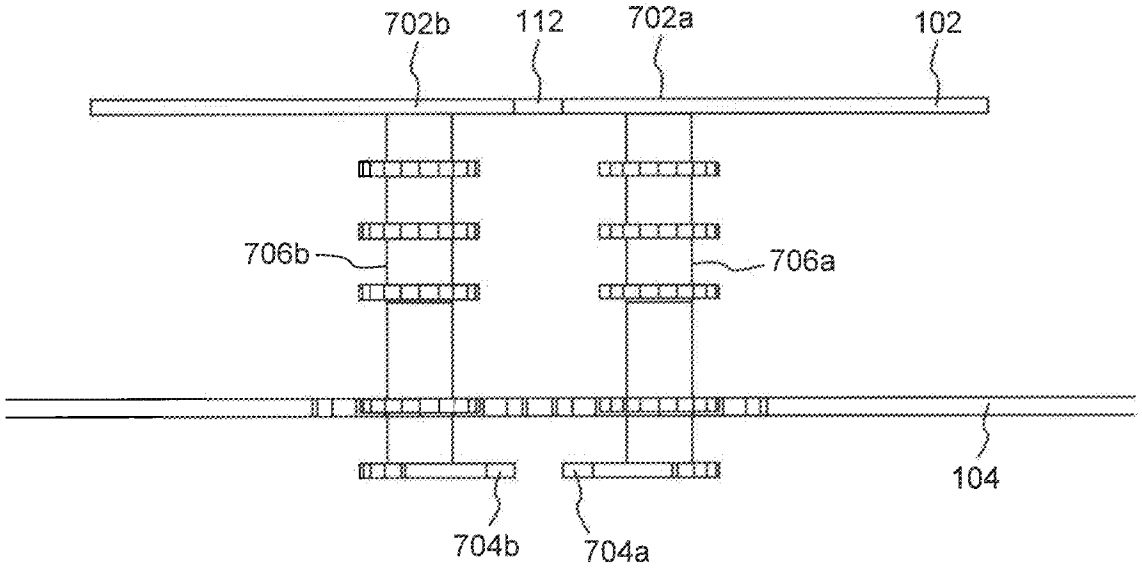
FIG. 8 is a side view of an example antenna system.

FIG. 8 is a side view of example antenna system 700 described above in FIG. 7. As shown in FIG. 7, in an embodiment, feed nodes 702*a* and 702*b* are electrically coupled, respectively, to feed line probes 704*a* and 704*b*, via respective through-chip vias 706*a* and 706*b*. Other ways for interconnecting feed nodes 702*a* and 702*b* to feed line probes 704*a* and 704*b*, respectively, may also be used as would be understood by a person of skill in the art.

Embodiments have been described above with the aid of functional building blocks illustrating the implementation of specified functions and relationships thereof The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the disclosure that others can, by applying knowledge within the skill of the art, readily modify and/or adapt for various applications such specific embodiments, without undue experimentation, without departing from the general concept of the present disclosure.

Therefore, such adaptations and modifications are intended to be within the meaning and range of equivalents of the disclosed embodiments based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of embodiments of the present disclosure should not be limited by any of the above-described exemplary embodiments, but should be defined only in accordance with the following claims and their equivalents.

What is claimed is:

1. A system, comprising:

a ground plane; and an antenna element including a plurality of nodes located within the antenna element, wherein the antenna element includes a slot and is mounted in a plane above the ground plane, and wherein the plurality of nodes include a plurality of grounding nodes located on a first side of the slot and a feed node located on a second side of the slot that is opposite the first side of the slot; and a plurality of switches, each of the plurality of switches located between a respective grounding node of the plurality of grounding nodes and the ground plane and controllable to selectively couple the respective grounding node to the ground plane, wherein the plurality of switches couple selected ones of the plurality of grounding nodes to the ground plane to configure the antenna element into a desired polarization type that is one of a circular polarization, an elliptical polarization, or a linear polarization.

2. The system of claim 1, further comprising:

a feed line probe, electrically coupled to the feed node, and configured to receive an input signal applied to the feed node.

3. The system of claim 1, wherein at least one of the plurality of grounding nodes is electrically coupled to the ground plane.

4. The system of claim 1, wherein each of the plurality of switches includes a respective varactor.

5. The system of claim 1, wherein the plurality of switches are each controllable by a respective control signal to configure the antenna element into the desired polarization type.

6. The system of claim 1, further comprising:

a plurality of input probes, each electrically coupled to a respective one of the plurality of nodes.

7. The system of claim 6, further comprising:

at least one switch, controllable to couple respective input signals to the plurality of input probes.

8. The system of claim 1, further comprising:

a plurality of feed line probes, each electrically coupled to a respective one of the plurality of nodes.

9. The system of claim 8, further comprising:

a differential phase shifter having an output coupled to the plurality of feed line probes.

10. The system of claim 9, wherein the differential phase shifter is configured to adjust a phase of the output to configure the antenna element into the desired polarization type.

11. The system of claim 10, wherein the differential phase shifter is configured to invert the phase of the output to reconfigure the antenna element from right-handed circular polarization to left-handed circular polarization, or vice versa.

12. The system of claim 1, wherein the plurality of switches configure the antenna element such that the desired polarization type corresponds to a first polarization type over a first frequency channel and to a second polarization type over a second frequency channel.

13. The system of claim 1, wherein the plurality of grounding nodes are incrementally displaced from one another along a length of the first side of the slot.

14. A system, comprising:

a ground plane;

an antenna element including a plurality of nodes located within the antenna element, wherein the antenna element includes first and second, slots and is mounted in a plane above the ground plane, and wherein a first node of the plurality of nodes is located between the first and second slots;

a plurality of input probes configured to receive respective input signals, each of the plurality of input probes electrically coupled to a respective one of the plurality of nodes, wherein the respective input signals configure each of the plurality of nodes as a feed node, a grounding node, or an open node to configure the antenna element into a desired polarization type that is one of a circular polarization, elliptical polarization, or a linear polarization.

15. The system of claim 14, wherein the respective input signals configure one of the plurality of nodes as a feed node and one of the plurality of nodes as a grounding node, thereby configuring the antenna element for the circular polarization.

16. The system of claim 14, wherein the respective input signals configure two of the plurality of nodes as feed nodes, thereby configuring the antenna element for the linear polarization.

17. The system of claim 14, wherein the respective input signals configure exactly one of the plurality of nodes as the feed node.

18. The system of claim 14, wherein the first node of the plurality of nodes is located between first sides of the respective first and second slots, and wherein a second node of the plurality of nodes is located on a second side of the one of the first or second slots that is opposite the first side of the corresponding first or second slot.

19. A system, comprising:

a ground plane;

a contiguous antenna element, mounted in a plane above the ground plane, the contiguous antenna element including a slot, a feed node located in a first location on a first side of the slot within the contiguous antenna element, and a grounding node located in a second location on a second side of the slot that is opposite the first side of the slot within the contiguous antenna element, wherein the grounding node is electrically coupled to the ground plane; and a feed line probe, electrically coupled to the feed node of the contiguous antenna element, wherein the first location and the second location are selected such that the antenna element is configured into a circular polarization (CP) over a desired CP bandwidth, with a single feed provided to the feed line probe.

20. The system of claim 19, wherein dimensions of the contiguous antenna element are selected such that a resulting impedance bandwidth of the antenna element substantially matches the desired CP bandwidth.

21. The system of claim 19, wherein the contiguous antenna element includes a single feed node.

22. A system, comprising:

a ground plane; and an antenna element including a slot and a plurality of nodes located within a plane of the antenna element, wherein the plane of the antenna element is disposed above the ground plane, and wherein the plurality of nodes include a plurality of grounding nodes located on a first side of the slot and a signal feed node located on a second side of the slot that is opposite the first side of the slot, the signal feed node configured to receive an input signal for radiation by the antenna element; and a plurality of switches, each of the plurality of switches located between a respective grounding node of the plurality of grounding nodes and the ground plane and controllable to selectively couple the respective grounding node to the ground plane to configure the antenna element into a desired polarization type that is one of a circular polarization, an elliptical polarization, or a linear polarization.

* * * * *

UNITED STATES PATENT AND TRADEMARK OFFICE

CERTIFICATE OF CORRECTION

PATENT NO. : 9,270,026 B2
APPLICATION NO. : 13/361570
DATED : February 23, 2016
INVENTOR(S) : Chryssoula A. Kyriazidou It is certified that error appears in the above-identified patent and that said Letters Patent is hereby corrected as shown below:

In the Claims

In column 8, line 11, please replace "second, slots" with --second slots--.

In column 8, line 22, please replace "polarization, elliptical polarization" with --polarization, an elliptical polarization--.

Signed and Sealed this
Fifth Day of July, 2016

Michelle K. Lee

Michelle K. Lee
*Director of the United States Patent and Trademark Office*